US005143515A

United States Patent [19]

Boster et al.

[11] Patent Number: 5,143,515

[45] Date of Patent: Sep. 1, 1992

[54] PUMP WITH SEAL PURGE HEATER

[75] Inventors: Clark S. Boster, Whittier; Sankaraiyer Gopalakrishnan, Brea; Carl F. Reimers, Fullerton; Gordhan K. Vaghasia, Cerritos, all of Calif.

[73] Assignee: BW/IP International, Inc., Long Beach, Calif.

[21] Appl. No.: 564,607

[22] Filed: Aug. 9, 1990

[51] Int. Cl.[5] ..... F01D 5/08

[52] U.S. Cl. ..... 415/179; 415/112; 277/20; 376/203; 376/310; 376/402; 417/366

[58] Field of Search ..... 277/22; 376/203, 310, 376/402; 417/366, 423.12, 423.13, 424.1; 415/110, 111, 112, 177, 178, 179, 180

[56] References Cited

U.S. PATENT DOCUMENTS

| | | | |
|---|---|---|---|
| 4,005,747 | 2/1977 | Ball | 277/22 |
| 4,109,920 | 8/1978 | Wiese | 415/112 |
| 4,690,612 | 9/1987 | Jenkins | 415/112 |
| 4,775,293 | 10/1988 | Boster | 415/112 |
| 4,932,836 | 6/1990 | Boster . | |

FOREIGN PATENT DOCUMENTS

| | | |
|---|---|---|
| 0111024 | 10/1982 | European Pat. Off. . |
| 5768585 | 4/1982 | Japan . |
| 5939992 | 3/1984 | Japan . |
| 64-4160 | 1/1989 | Japan . |
| 178792 | 7/1989 | Japan . |

*Primary Examiner*—Edward K. Look
*Assistant Examiner*—Christopher M. Verdier
*Attorney, Agent, or Firm*—Joseph R. Dwyer

[57] ABSTRACT

A pump assembly which overcomes a shaft and cover cracking problem comprising a means for heating the seal purge water flowing along the shaft before it exits into an annulus (mixing region) thus reducing the temperature difference between the cooler seal purge water and the hotter product water prior to the mixing of the two waters. Three embodiments of the invention include 1) a cover sleeve surrounding the pump shaft which extends into the hydrostatic bearing (mixing region) so as to be heated by the product water and thereby heating the seal purge water before mixing with the product water, 2) a rotating shaft sleeve surrounding the pump shaft which extends into the hydrostatic bearing (mixing region) to heat the seal purge water by circulating product water before mixing with the product water and 3) a rotating baffle type heat exchanger extending into the hydrostatic bearing (mixing region) to heat the seal purge water flowing in a bi-directional path by product water also flowing in a bi-directional path before mixing with the product water.

11 Claims, 9 Drawing Sheets

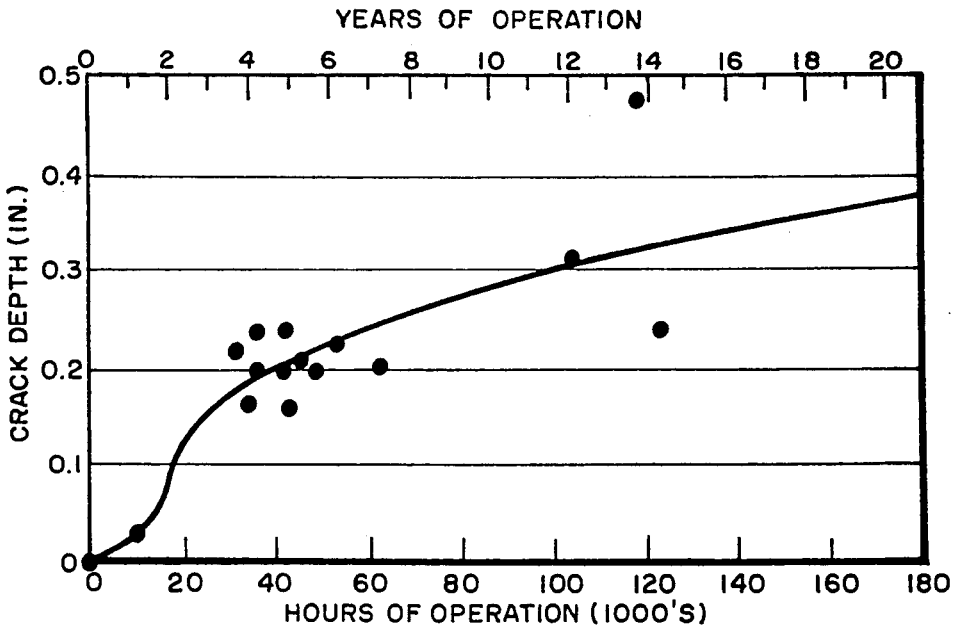
*Fig. 4.* SHAFT THERMAL FATIGUE AXIAL CRACK GROWTH vs TIME
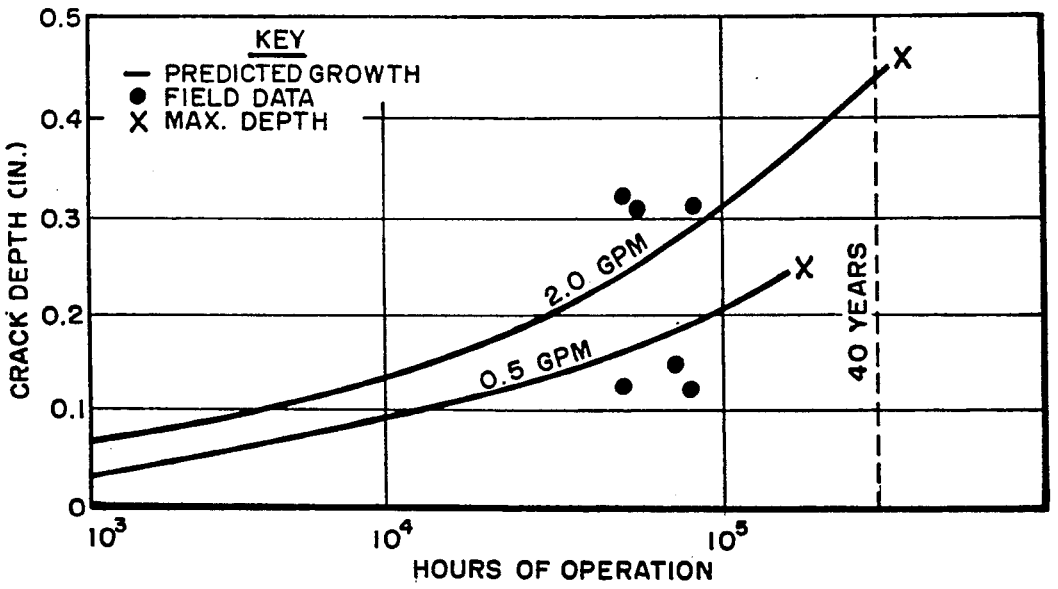
*Fig. 5.* COMPARISON OF COVER THERMAL FATIGUE PREDICTIONS WITH FIELD DATA

PUMP WITH SEAL PURGE HEATER

BACKGROUND OF THE INVENTION

1. Field of Invention

This invention relates to pumps which are designed for pumping high pressure, high temperature, demineralized water (product water), such as used in boiling and pressurized water nuclear reactors. These pumps have a plurality of heat exchangers to cool the shaft seals and other components and this invention is specifically directed to the improvement of these heat exchangers to solve the problem of shaft and cover thermal cracking from the effects of seal purge water and product water mix and thus prolong the operating life of the pump assembly.

2. Prior Art

FIG. 1 shows a prior art pump assembly and FIG. 2 shows an impeller and hydrostatic bearing in the pump assembly of FIG.1. FIG. 3 is a schematic illustration of the working relationship of the heat exchangers in the pump assembly of FIG.1.

More specifically, FIG. 1 shows a pump assembly 10 which includes a pump housing 11, one outlet port 12 and a motor 13 connected to one end of a shaft 14, which extends through a bore 15 in a pump cover 16, for driving impeller 17 as shown in FIG.2. The pump impeller 17 with its inlet port 18 and outlet ports 20 is shown connected to a cylindrical journal 21 and surrounded by a hydrostatic bearing 22 and pumps product water, represented by arrows 23, at high pressure through outlets 20. This pump assembly 10 is described in detail in the U.S. Pat. No. 4,775,293 of Boster to which reference may be made.

FIG.3 shows the motor 13 attached to the shaft 14, shown as a center line, to drive the impeller 17. FIG.3 also shows three heat exchange areas 24, 25 and 26; the latter being the cover bore 15 incorporating this invention as an improvement in the entire pump assembly, which improvement will be described last so that the problem solved by this invention may be discussed at length.

Thus, the first heat exchanger area 24 is shown within a driver mount 27 surrounding a stuffing box 28 in which component cooling water, represented by arrows 30, is passed through a heat exchanger 31 surrounding the stuffing box 28 and then down through a plurality of vertical holes 32 located near bore 15 in cover 16. Thereafter the component cooling water 30 is returned through the heat exchanger 31 and out through the driver mount 27 opening.

Seal purge water, represented by arrows 33, is injected into the stuffing box 28 where it is circulated by an auxiliary impeller 34 driven by the shaft 14 to circulate through an external heat exchanger 35. Heat exchanger 35 comprises helically formed tubes, represented by staggered lines 36, located in a water jacket 37 which is also cooled by component cooling water 30. Excess seal purge water 33 is also directed along the shaft 14, through a bore 15 in the cover 16, and into a mixing region 38 located where shaft 14 exits bore 15. Product water 23 is circulated from the outlet 12 through the hydrostatic bearing 22 into the mixing region 38.

The seal purge water 33 in the area of the auxiliary impeller 34 also cools a multi-stage mechanical seal assembly comprising mechanical seals 40 and 41 which prevent liquid from entering the motor 13 or the adjacent environment. The lower mechanical seal 40 is subjected to the full pressure of the seal purge water 33 which also flows, as a controlled bleed off, through a staged pressure reducing means, represented by the staggered lines 33*a*, so that the pressure in area 42 between the two mechanical seals is reduced by one-half. The second mechanical seal 41 is subjected to the reduced pressure in area 42 which is bled off through a second stage pressure reducing means, represented by staggered lines 33*b*, so that the pressure in area 43 between the motor 13 and the second mechanical seal 41 is reduced to almost zero where the seal purge water 33 is then directed out the stuffing box 28 as shown at 33*c*. The area containing the mechanical seals 40 and 41 is called a "seal cavity" and includes a "seal stage area". The mechanical seals 40 and 41 and the stage pressure reducing means themselves are fully described in the U.S. Pat. No. 4,586, 719 of Marsi et al and in the U.S. patent application, Ser. No. 07/488,238, filed Mar. 1, 1990, by Marsi entitled "Mechanical Seal" so no further details of the mechanical seal assembly need to be described.

The second heat exchanger area 25 containing the shaft driven auxiliary impeller 34 and the external heat exchanger 35 serves to maintain the seal purge water 33 at a low temperature so that the mechanical seals 40 and 41 are protected against overheating and purged of particulate matter.

As an alternative to the auxiliary impeller type heat exchanger, the heat exchanger may comprise a multi-flow, multi-path rotating baffle type heat exchanger which surrounds the shaft 14 and, like the auxiliary impeller 34, is located between the impeller 17 and the mechanical seal assembly. This heat exchanger 25 is also subjected to excess purge water 33, ie, more than necessary to purge the mechanical seals which is directed along the shaft 14 through the bore 15 in the cover 16. This rotating baffle type heat exchanger is fully described in the U.S. Pat. No. 4,775,298, supra, so no further details concerning the function and operation of this type of heat exchanger need to be described further. See also U.S. Pat. No. 4,005,747 of Ball.

These heat exchangers, whether of the auxiliary impeller type or the rotating baffle type serve to prevent heating and damage to the mechanical seals 40 and 41 if the flow of seal purge water 33 were to cease. This is represented by arrows 23*a* showing product water 23 flowing upwardly along shaft 14 and into the external heat exchanger 35 where the seal controlled bleed off water is cooled. This is also fully explained in the two patents referenced above.

It is to be understood also that either of these heat exchangers may be used in connection with this invention although the invention is disclosed in connection with the rotating baffle type heat exchanger.

The third heat exchanger area 26 is in the region in which the shaft 14 passes through the bore 15 and is near the hydrostatic bearing 22 where the flow of excess seal purge water 33 enters the mixing region 38 and mixes with the product water 23. As best seen in FIG.2, the mixing region 38 is defined by an annulus 43 below the cover 16 where the shaft 14 is within the hydrostatic bearing. Hydrodynamically induced turbulences and non-uniform flow paths between the product water 23 in an area 44, adjacent to the top of the hydrostatic bearing 22, and the product water 23 in the mixing region 38 causes the product water 23 to enter and mix with the seal purge water 33 in the mixing region 38 and impinge on the shaft 14 and cover 16 where the shaft 14 exits the bore 15. The mixture then exits to the low pressure zone of the impeller 17 through openings 45.

However, as excess seal purge water 33 flows along the pump shaft 14 and through the bore 15, very little heat-up occurs. Thus, temperature of the seal purge water 33 is substantially the same as when it entered the seal cavity.

Since the mixing region 38 contains high temperature water from the hydrostatic bearing, mixing of the hot and cold water will occur in this area. This mixing results in localized hot and cold flow regimes alternately impinging on the shaft 14 and cover 16 in the mixing region 38. The cyclical heating and cooling induces surface thermal stresses both in the cover bore 15 and on the surface of the shaft 14 which, over a period of time, can result in cracking. These cracking areas are represented by dashed lines 46 and 47 in the shaft and cover, as shown in FIG.2. Some of the cracks not only penetrate deeply, but may be oriented so they can lead to a structural failure of either or both the cover and the shaft.

Extensive calculations have been made to identify mechanisms of crack initiation and propagation as well as to develop means for mitigating cracking tendencies. The calculations simulate the mixing phenomenon by hypothesizing pulsations at various frequencies and amplitudes. The results decribe crack depths as a function of total operating time. FIG. 4 shows such a calculated result compared against field data obtained from operating plants worldwide. The fact that there is good agreement between theory and actual observations leads to the belief that the theory is sound and that counter measures against cracking can be established.

It is clear that the root cause for crack initation is the high temperature difference ($\Delta T$) at the exit of the thermal barrier between the seal purge water 33 and the product water 23. Parametric studies have shown that this $\Delta T$ cannot be reduced significantly by changing operating conditions. For example, increasing seal purge water at the point of injection temperature reduces the $\Delta T$ only by the amount of the inlet temperature increase. Since cracking cannot be prevented unless $\Delta T$ is reduced to below about 100 degrees F., and the normal $\Delta T$ is about 330 degrees F. (this number has been obtained by detailed calculations), this injection temperature has to be increased by over 200 degrees F. This is not acceptable because of seal cavity temperature limitations. Also, changing the flow of seal purge water 33 is not totally effective. FIG.5 shows that decreasing net downflow to 0.5 gpm reduces cracking tendency, but does not eliminate it. Completely eliminating seal purge water 33 will eliminate cracking at the bottom of the cover 16, but since controlled bleed-off flow for the mechanical seals 40 and 41 has to be from product water 23, mixing will occur at the top of the cover bore 15 and cause cracking there. Calculations and field observation have confirmed this.

As a result of these studies, it has been concluded that the $\Delta T$ itself has to be decreased. Since the temperature of the seal purge water 33 has to be maintained below about 150 degrees F., it is necessary to heat the down flowing seal purge water 33 after it leaves the seal cavity area and before mixing with the product water 23. This patent application covers a concept of purge water heating as mentioned above.

SUMMARY OF THE INVENTION

The improvement in pump assemblies which overcomes the shaft and cover cracking problem comprises a means for heating the flow of seal purge water flowing along the shaft before it exits into an annulus (mixing region) thus reducing the temperature difference between the cooler seal purge water and the hotter product water prior to the mixing of the two waters. Three embodiments of the invention include 1) a shaft sleeve surrounding the pump shaft which extends into the hydrostatic bearing (mixing region) so as to be heated by the product water and thereby heating the seal purge water before mixing with the product water, 2) a rotating shaft sleeve surrounding the pump shaft which extends into the hydrostatic bearing (mixing region) to heat the seal purge water by circulating product water before mixing with the product water and 3) a rotating baffle type heat exchanger extending into the hydrostatic bearing (mixing region) to heat the seal purge water by circulating product water before mixing with the product water.

BRIEF DESCRIPTION OF THE DRAWINGS

FIG.4 is a graph showing shaft thermal fatigue axial crack growth versus time, FIG. 5 is a graph showing a comparison of cover thermal fatigue predictions with field data.

DETAILED DESCRIPTION

Figure 1:
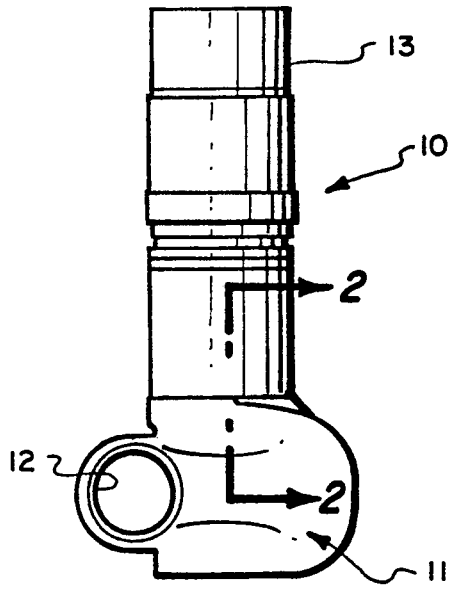
Fig. 1. (PRIOR ART)
FIG. 1 is an elevational view of a pump assembly of the prior art as described above.
Figure 2:
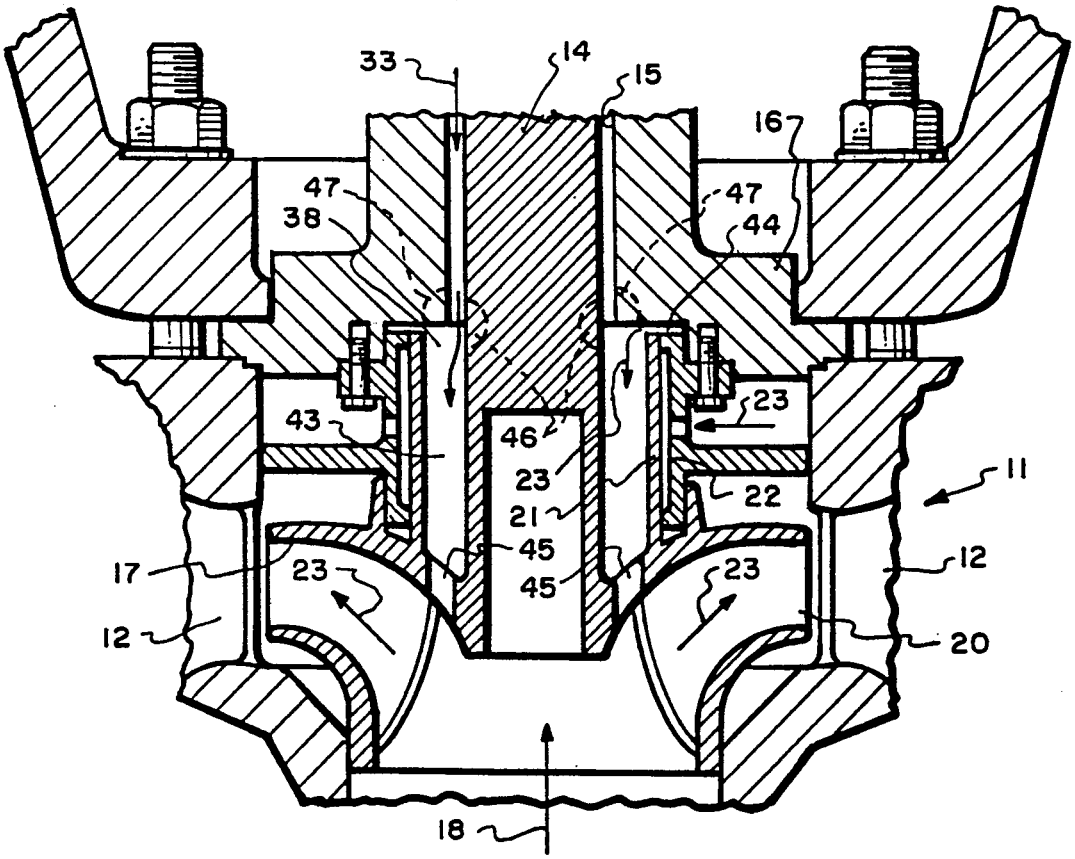
Fig. 2. (PRIOR ART)
FIG. 2 is a fragmentary sectional view, taken along 2—2 of FIG.1, to show the pump impeller, shaft and hydrostatic bearing in more detail.
Figure 3:
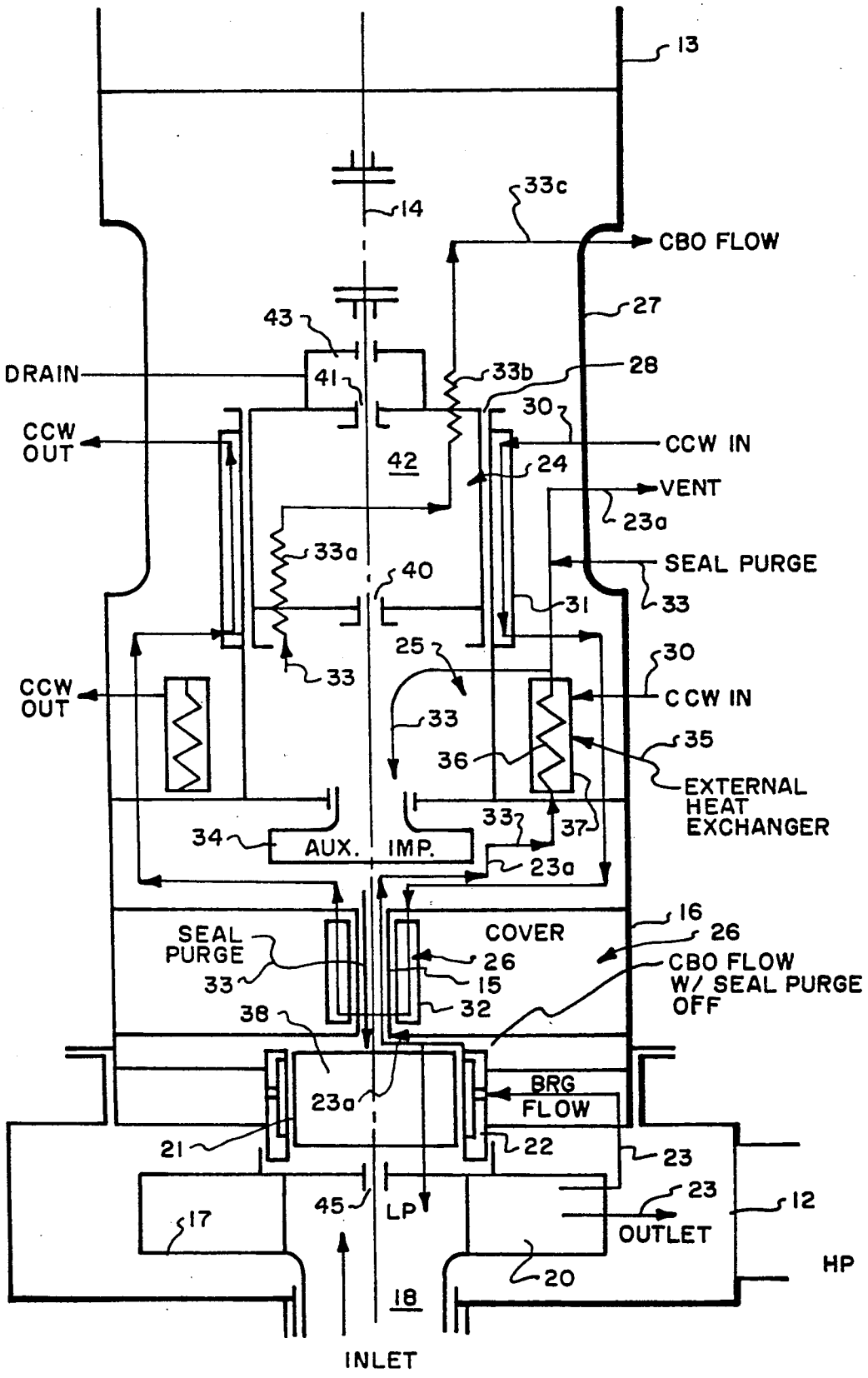
Fig. 3. (PRIOR ART)
FIG.3 is a schematic illustration of the pump assembly of FIGS. 1 and 2 with heat exchangers and showing the flow of the various fluid streams.

As will be apparent, the improved pump assembly with a rotating baffle type heat exchanger is first shown schematically and then in detail to facilitate understanding of the invention. Also to simplify the description, those components which are identical, or have identical functions, will be given the same reference numerals throughout the various figures.

Figure 6:
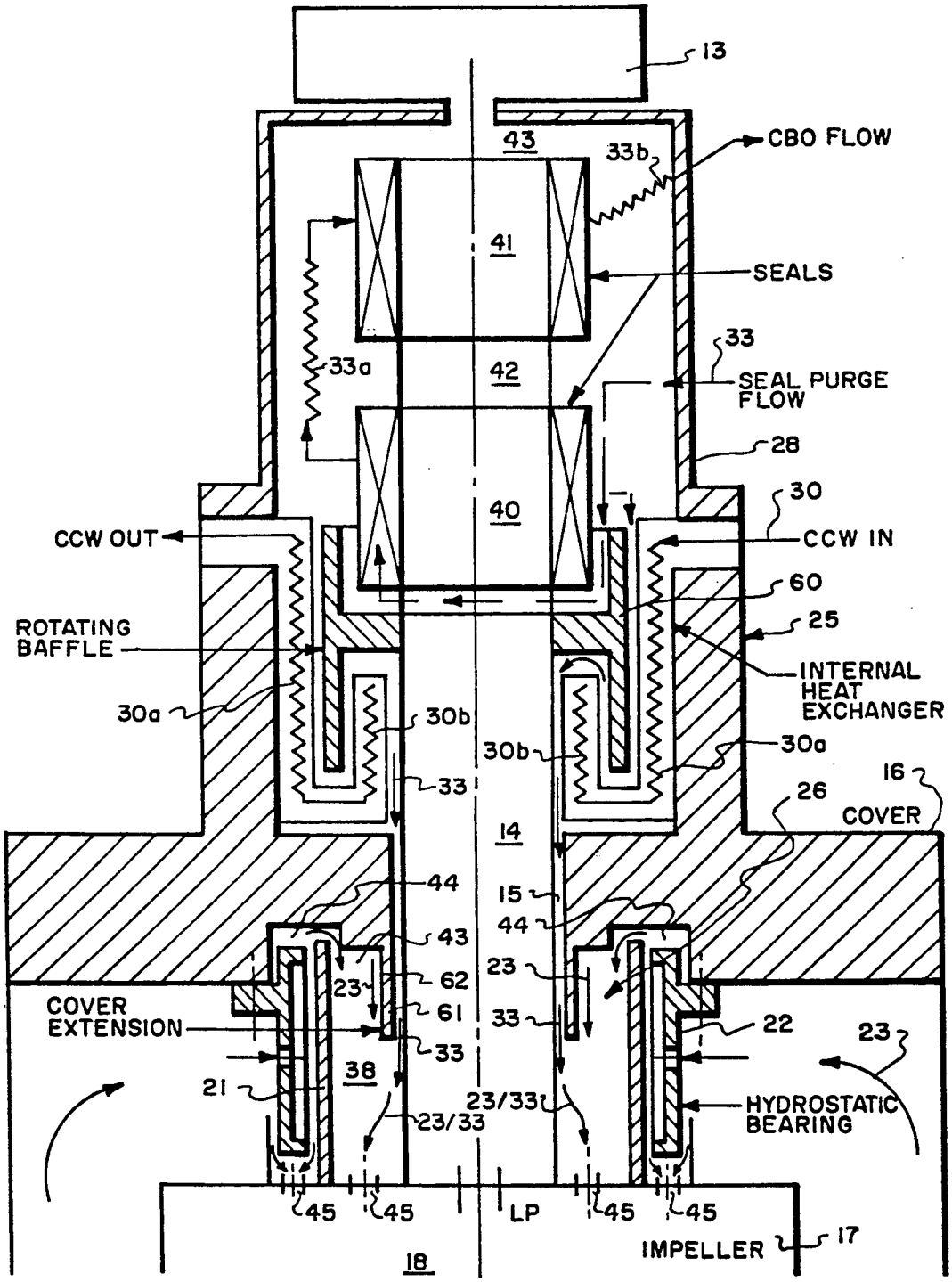
FIG. 6 is a schematic illustration of a pump assembly like FIG. 3 but with a rotating baffle type heat exchanger and showing a means of heating the seal purge water before it mixes with the product water.

FIG. 6 shows the motor 18, shaft 14 with mechanical seals 40 and 41 and the stage pressure reducing means **33*a* and 33*b* which will not be described further. In this illustration, stuffing box 28 is shown integral with cover 16**.

FIG. 6 also shows the second heat exchanger area 25 contains a heat exchanger of the rotating baffle type. This heat exchanger is a multi-flow, multi-path heat exchanger which surrounds the shaft 14 and is located between the impeller 17 and the mechanical seal assembly. This heat exchanger is also subjected to excess seal purge water 33, ie, more than necessary to purge the mechanical seals and which is directed around a shaft driven rotating baffle 60, then upwardly and downwardly along shaft 14 through the bore 15 in cover 16. This rotating baffle type heat exchanger is also subjected to component cooling water, again represented by arrows 30 and by staggered lines 30*a* and 30*b* on both sides of the rotating baffle 60, but out of contact therewith. Component cooling water then exits the heat exchanger.

FIG.6 also illustrates a seal purge water heater in the form of a cover extension 61 integral with cover 16 extending into the annulus 43 (mixing region) of the hydrostatic bearing 22 so product water 28 impinges on the outer wall 62 of the cover extension 61 thereby heating the seal purge water 33 and thus reducing the temperature difference between the exiting seal purge water 33 and the product water 23. The amount of heat transfer from the cover extension 61 depends upon the thickness and length of the cover extension 61.

Figures 7, 7A:
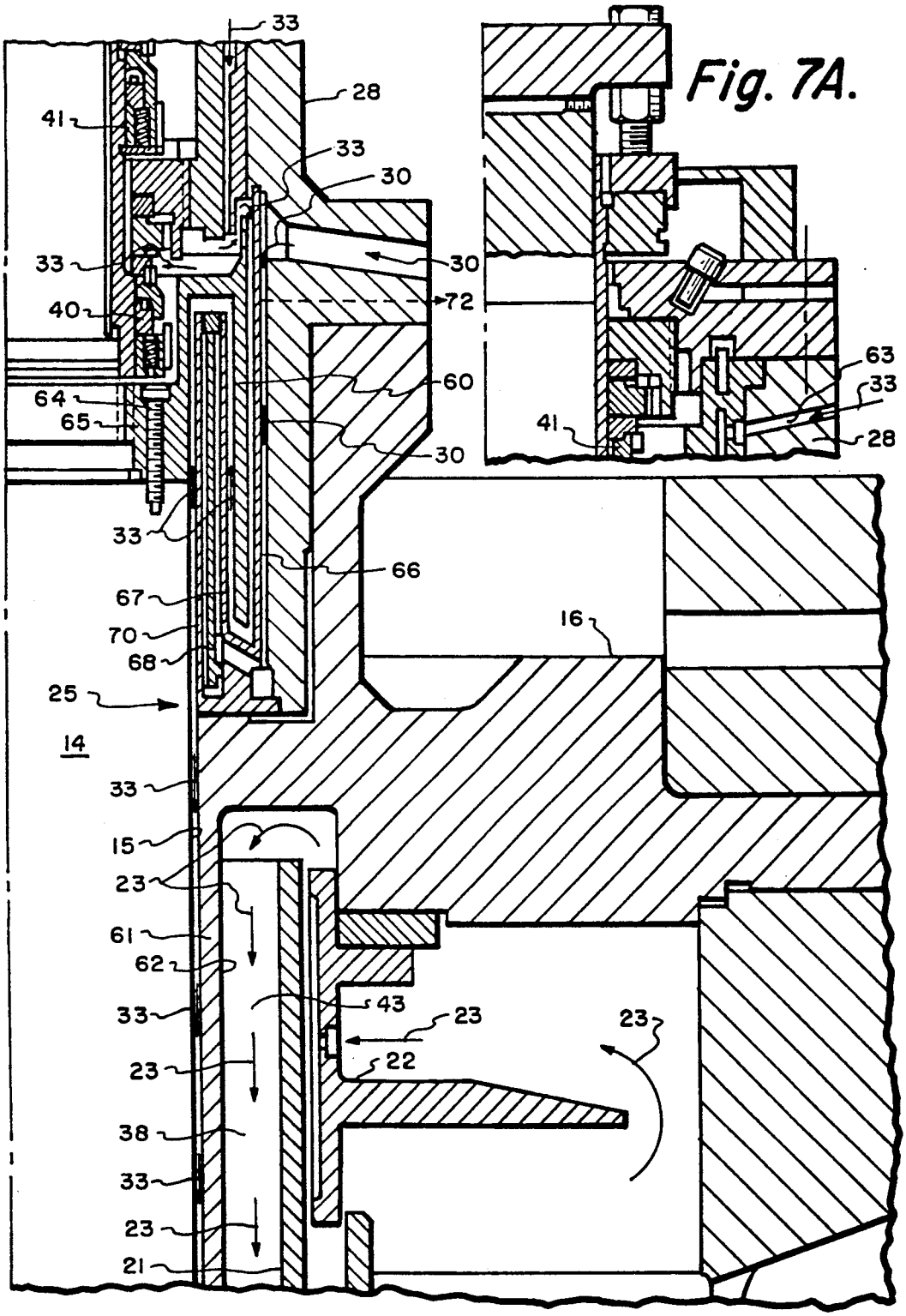
FIGS. 7 and 7A are a more detailed view of the heater of FIG. 6.

In FIGS. 7 and 7A, being a more detailed view of the pump assembly of FIG. 6, it can be seen that the seal purge water 33 and the component cooling water 30 circulate in the heat exchanger 25 as shown schematically in FIG. 6. More specifically, seal purge water 33 is injected at inlet 63 (FIG. 7A) and the arrows 33 show the flow of the seal purge water 33 down and around the rotating baffle 60 and finally down along the bore 15 between the shaft 14, shaft extension 61 and the cover 16. Baffle 60 is connected to shaft 14 by bolts 64, or other suitable means, through a radial flange 65 integral with rotating baffle 60. Radial flange 65 is connected in any suitable manner to shaft 14. Rotating baffle 60 is disposed between cylindrical stationary plates 66, 67, 68 and 70. Either the seal purge 33 when activated or product water 23 passes between the rotating baffle and plates for cooling. The plates are linked together at the top and bottom in such a manner as to direct the flow of component cooling water 30 in a serpentine path before exiting the heat exchanger at 72. Again, as in FIG. 6, product water 23 entering the annulus 43 (mixing region 38) will flow downwardly along the outer wall 62 of the cover extension 61 thereby heating the cover extension 61 and the terminal flow of the seal purge water 33 and thereby reducing the temperature difference between the seal purge water 33 and the product water 23 as the seal purge water enters the mixing region.

Figure 8:
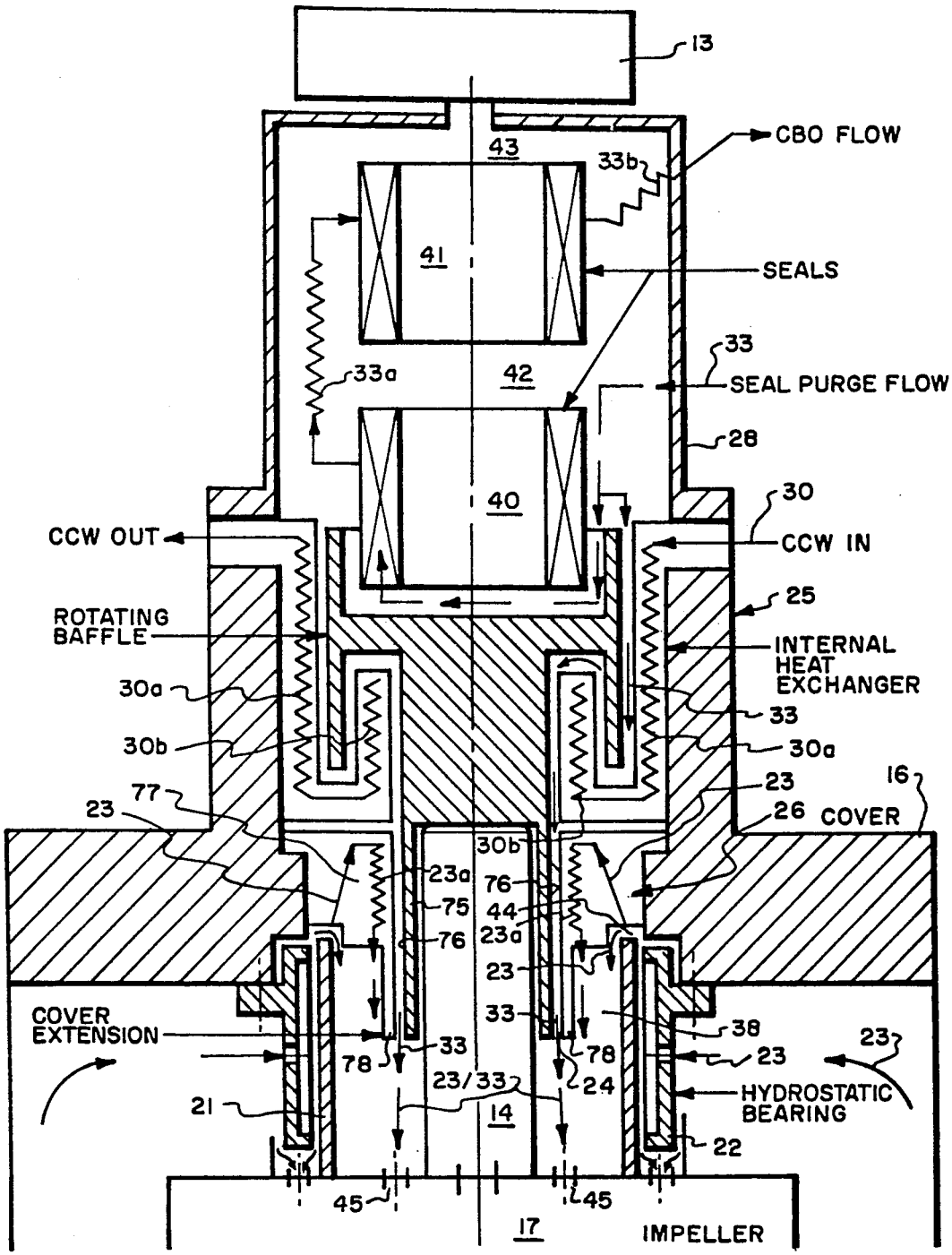
FIG. 8 is a schematic illustration of a pump assembly like FIG. 6 but showing another way to heat the seal purge water before it mixes with the product water.

FIG. 8 shows a second embodiment of the seal purge water heater which comprises a downwardly extending rotating shaft sleeve 75 driven by shaft 14 so that the seal purge water 33 from the heat exchanger 25 flows down an outer wall 76 of the sleeve 75 and between a heater 77. The heater 77 also has a downwardly extending sleeve 78 concentric to the sleeve 75 but spaced therefrom. Product water 23 from the higher pressure area 44 at the top of the hydrostatic bearing 22, enters the heater 77 above the area 44, through a plurality of passages, represented by arrows 23, and is directed inwardly and downwardly, represented by staggered lines 23*a*, which heats the sleeve 78 and the seal purge water 33 flowing along outer wall 76. The hot product water 23 is caused to flow through the heater 77 by the difference in centrifugally induced pressure in area 44 relative to the pressure in the mixing region 38.

Figure 9:
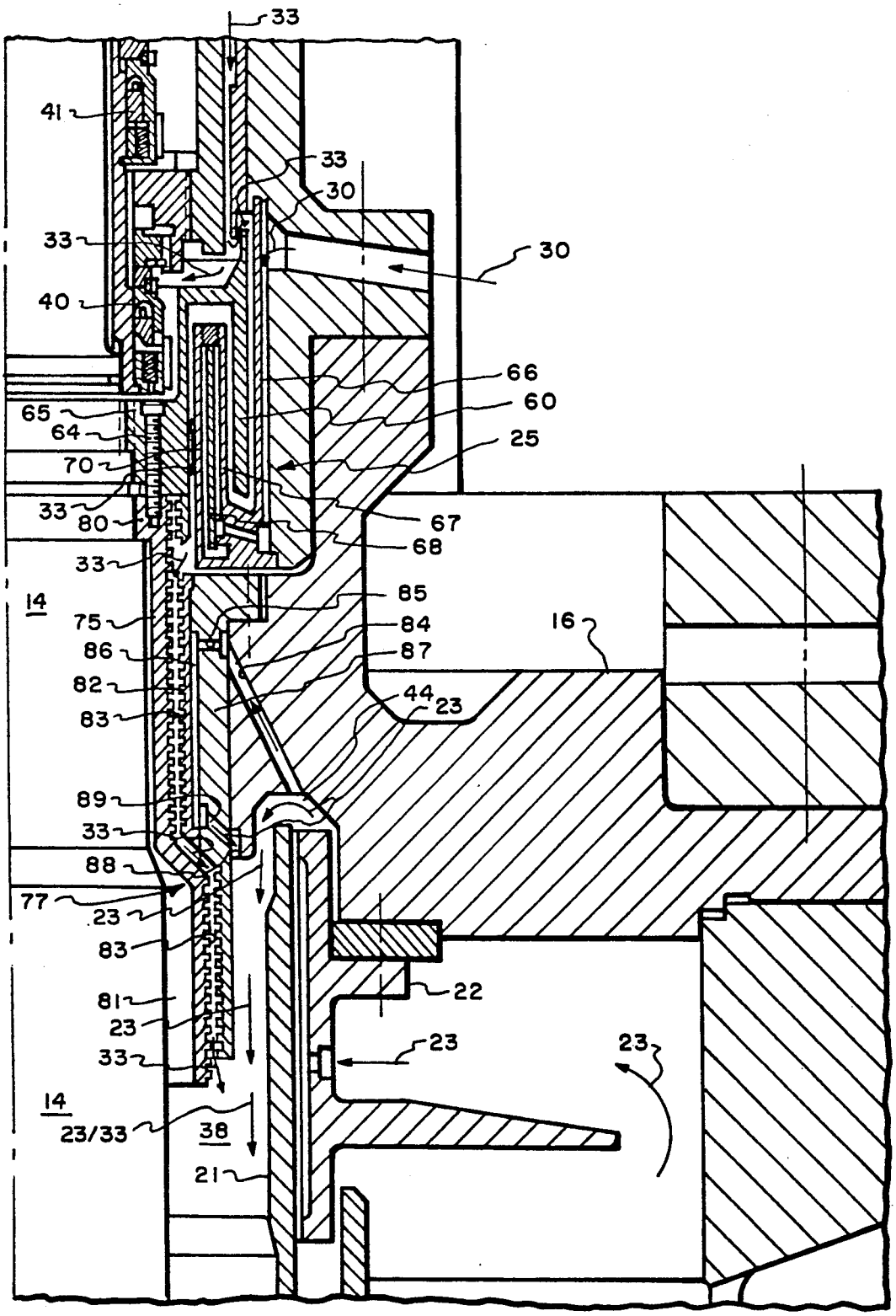
FIG. 9 is a more detailed view of the heater of FIG. 8 and its relationship to the shaft and hydrostatic bearing.

FIG. 9 is a more detailed view of the heater 77 of FIG.8 and also shows a rotating baffle type heat exchanger 25 as described in FIG. 7. In this embodiment, bolts 64 through radial flange 65 connect the rotating baffle 60 to a radial flange 80 of rotating shaft sleeve 75 to be driven by shaft 14. Radial flange 65 is connected to the shaft in any suitable manner as described above in connection with FIG.7. Sleeve 75 extends downwardly along the shaft 14 and flares outwardly of the shaft to provide an annulus 81 surrounding the shaft where the sleeve 75 then extends into the mixing region. Thus, the mixing of the cool seal purge water 33 and the hotter product water 23 takes place well away from the shaft 14. A stationary sleeve 82 is spaced from sleeve 75 and both sleeves have helical non-intermeshing grooves 83 which face each other to facilitate heat transfer of seal purge water flowing downwardly. Product water 23 in area 44, being at a centrifugally induced high pressure, flows through passages 84 and 85 and into a space 86 formed by a second stationary sleeve 87 which surrounds sleeve 82. Space 86 opens into the mixing region 38 by passage 89 and opening 88 where the product water 23 exits into the mixing region 38. This hot product water 23 heats the sleeve 82 along almost its entire length to increase the temperature of the seal purge water 33 before it mixes with the product water 23.

Figure 10:
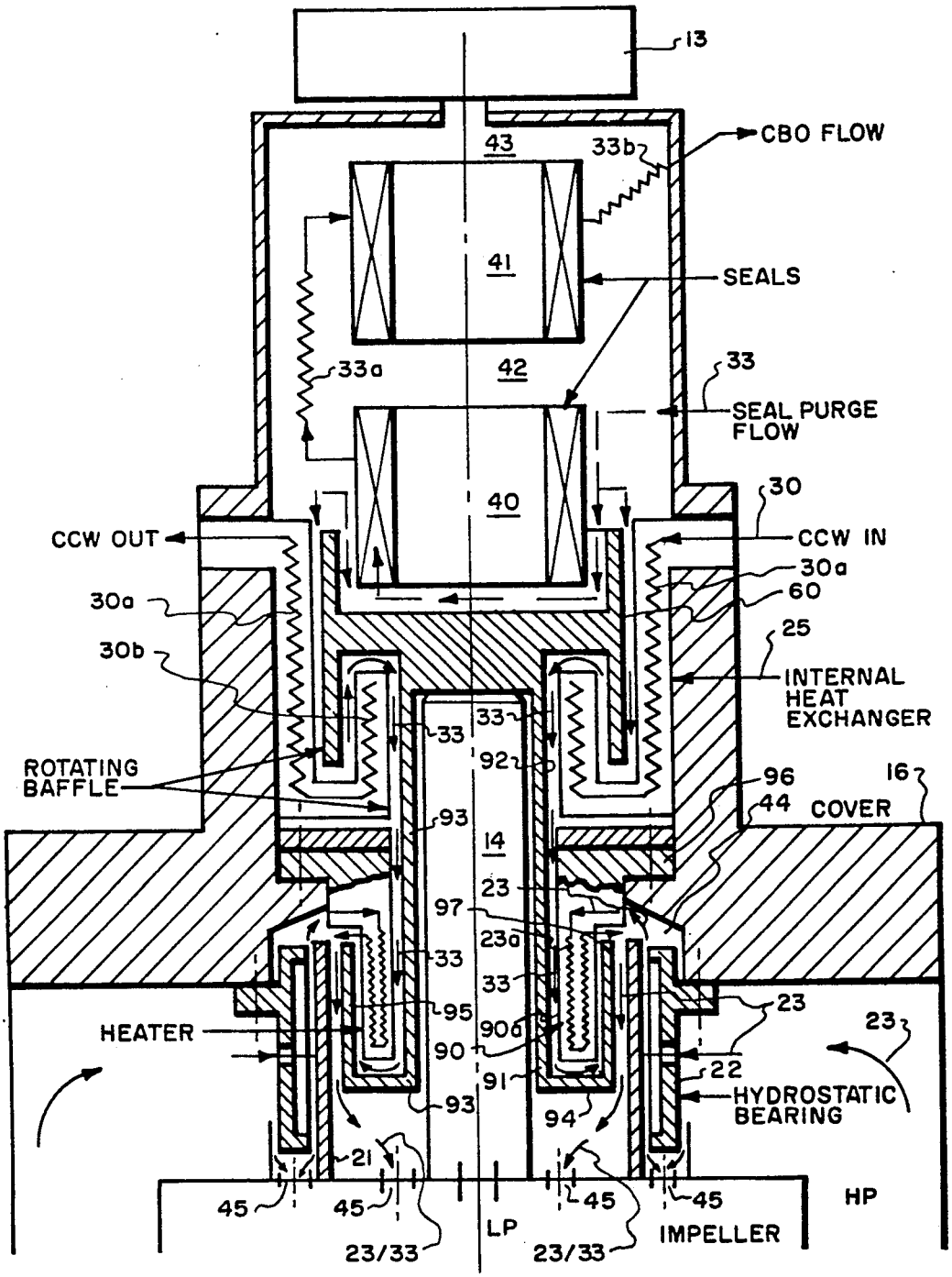
FIG.10 is a schematic illustration of a pump assembly like FIGS. 6 and 8 but showing another way to heat the seal purge water before it mixes with the product water and, FIG. 11 is a more detailed view of the heater as shown schematically in FIG.10.

FIG. 10 is a schematic illustration of another embodiment of a seal purge water heater in the form of rotating baffle type heat exchanger 90. A rotating baffle 91 of this heat exchanger 90 is connected to rotate with the rotating baffle 60 and the seal purge water 33 flows from the rotating baffle exchanger 25 along the outside wall 92 of a sleeve 93 surrounding shaft 14 and comprises the inner cylindrical support for rotating baffle 91. This rotating baffle 91 differs from the rotating baffle 60 in that the rotating parts surround the stationary parts. Sleeve 93 terminates at its lower end in a radially outwardly extending wall 94 which links sleeve 93 with a shorter upwardly extending wall 95 and spaced from wall 92. Wall 95 is spaced from the hydrostatic bearing 22 and defines a flow path for the seal purge water 33 and the product water 23. Product water 23 from the area 44 flows first upwardly and inwardly through a header 96 and then downwardly near the flow of seal purge water 33 separated by a metal wall 90*a* in heater 90 as seal purge water flows along the outside wall 92. Product water flow inside the heater 90 is represented by staggered lines 23*a*. The seal purge water 33 continues along the inside surface of wall 94 and up the inside surface of wall 95 exiting at the top edge 97 where it combines with the flow of product water 23 and passes on into the low pressure region of the impeller through ports 45.

Figure 11:
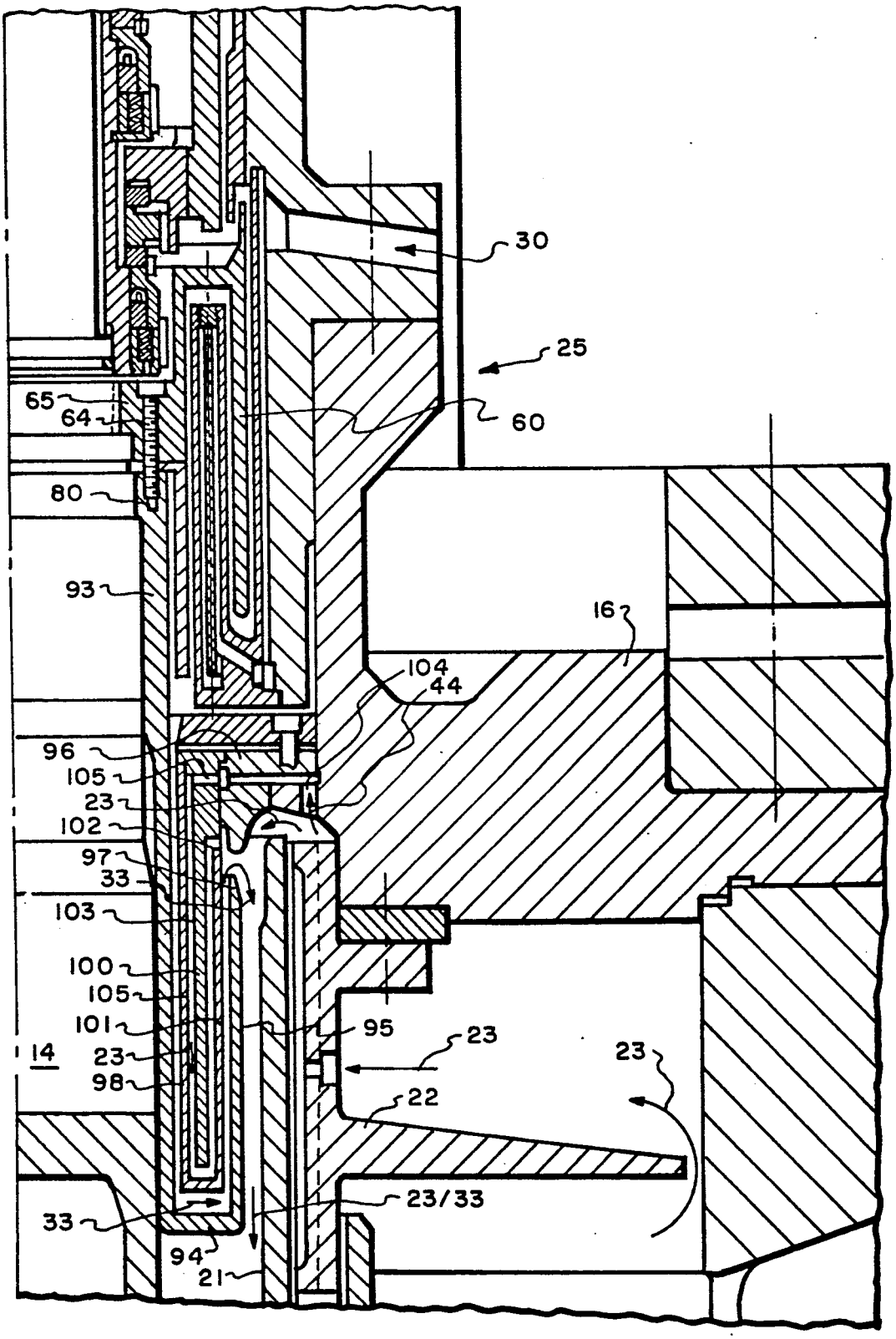

FIG. 11 is a more detailed illustration of the heater of FIG. 10 showing sleeve 93 connected to the radial flange 65 of the rotating baffle 60 by bolts 64. Sleeve 93 extends downwardly into the hydrostatic bearing area and shorter wall 95 extends upwardly to a point almost at the top of the hydrostatic bearing 22. Within the space between sleeve 93 and wall 95 are stationary plates 98, 100 and 101. Plates 98 and 101 are relatively thin and extend from the header 96, down and around the inner plate 100 and upwardly terminating at 102 slightly above the top edge 97 of wall 95. Plate 98 is spaced from the inner plate 100 and defines a flow path for the product water 23 downwardly along the outer wall of plate 98 and upwardly along the inner wall of plate 101 which is also spaced from the outside wall 95 for the bi-directional flow of seal purge water 33. Header 96 contains passages 104 and 105 connecting the area 44 containing the high pressure product water 23 to the space 103 between plate 98 and plate 100 so that product water will heat plates 98 and 101 on both sides as the seal purge water 33 flows along plate 101 and wall 95. Both the product water 23 and the seal purge water 33 mix at the opening defined by the top edges 97 and 102 and flows down along the outside of wall 95 to the zone of low pressure in the impeller 17. In this embodiment, mixing of the seal purge water 33 and the product water 23 occurs well away from the shaft 14. The temperature difference in the mixing zone of this embodiment can be reduced to a safe level at normal operating conditions thus thermal cracking from this source is essentially eliminated.

We claim:

1. A pump having an impeller for pumping high temperature product water connected to a motor by a shaft with sealing means around said shaft with said sealing means being subjected to cooler seal purge water to cool and prevent contamination of said sealing means and a first heat exchanger subjected to said seal purge water and component cooling water located between said impeller and said sealing means to protect the sealing means from said high temperature product water and wherein said cooler seal purge water is directed from said first heat exchanger toward said impeller to cool said shaft and to be mixed with said high temperature product water, the improvement comprising:

means for heating said seal purge water before it mixes with said product water including, a second heat exchanger means extending along said shaft for separating said seal purge water from said product water as said seal purge water flows along said shaft, said second heat exchanger means being thermally conductive and having an inner wall defining a first passage for the flow of said seal purge water and an outer wall defining a second passage for the flow of product water, both said passages having outlets near said impeller in a mixing region containing product water at low pressure, means for centrifugally generating a source of product water at a higher pressure than the pressure in said mixing region and in an area located radially outward of said shaft and said second heat exchanger, inlet means located radially outwardly of said shaft and said second heat exchanger opening said second passage to the high pressure product water in said area thereby forming a pressure gradient between the high pressure product water in said area and the lower pressure product water in said mixing region causing the flow of product water along said outer wall to heat said purge water in said first passage by thermal conductivity.

2. The pump as claimed in claim 1 wherein said second heat exchanger means comprises sleeve means extending toward said impeller and surrounding said shaft.

3. The pump as claimed in claim 2 wherein said means for centrifugally producing an area of high pressure comprises a hydrostatic bearing.

4. The pump assembly as claimed in claim 1 wherein said heating means comprises a rotating baffle rotatable by said shaft extending toward said impeller and through which said seal purge water is directed in a bi-directional flow and in which said product water is also directed in a bi-directional flow to heat said seal purge water before it mixes with said product water.

5. A pump assembly comprising, a motor joined at one end of a pump shaft and an impeller joined to the other end of said shaft to pump high temperature product water, said impeller being rotatable in an impeller chamber, sealing means surrounding said shaft adjacent said motor and subject to cool seal purge water to cool said sealing means and to prevent contamination thereof, a heat exchanger located between said impeller and said sealing means and subjected to said seal purge water and component cooling water to prevent overheating of said sealing means, said seal purge water being also directed toward said impeller to cool said shaft near said impeller, and means located between said heat exchanger and said impeller for heating said seal purge water before it mixes with said product water in a mixing region, said means including, first sleeve means extending along a length of said shaft and into said mixing region, first annular body means surrounding said first sleeve means and spaced therefrom to define a first space therebetween, said first space being in communication with said heat exchanger so that said seal purge water is directed through said first space and into said mixing region, and means for heating said first body means by directing product water along an outer surface of said first body means, including, second annular body means spaced from said first body means and defining a second space therebetween, means for centrifugally generating a high pressure zone of product water, the pressure in said zone being higher than the pressure in said mixing region, and means communicating said zone with said second space to direct the product water through said second space and into said mixing region.

6. The pump assembly as claimed in claim 5 wherein said means for generating said high pressure zone is located radially outwardly of said shaft and said sleeve and body means.

7. The pump assembly as claimed in claim 6 wherein said first sleeve means is rotatable by said shaft.

8. The pump assembly as claimed in claim 7 wherein said first space is configured to direct said seal purge water away from said shaft before entering said mixing region.

9. The pump assembly as claimed in claim 8 wherein an outer surface of said first sleeve means and an inner surface of said first body means are each provided with helical grooves to facilitate the heat transfer to said seal purge water flowing through said first space.

10. The pump assembly as claimed in claim 8 wherein said seal purge water is directed away from said shaft by said first sleeve means having an extension which surrounds said first body means so that the seal purge water first travels in a first direction toward said impeller and then in a second direction toward the heat exchanger before entering said mixing region.

11. The pump assembly as claimed in claim 8 wherein said first space means not only directs the flow of said seal purge water to a direction away from said shaft and in a second direction but also said product water in said second space is directed first in one direction and then in a second direction before entering said mixing region so that both said seal purge water and said product water are directed away from said shaft before entering said mixing region.

* * * * *